US011433436B2

(12) United States Patent
Coughlin et al.

(10) Patent No.: US 11,433,436 B2
(45) Date of Patent: Sep. 6, 2022

(54) CAROUSEL FOR ULTRASONIC CLEANING AND METHOD OF USING THEREOF

(71) Applicant: Applied Materials, Inc., Santa Clara, CA (US)

(72) Inventors: Michael J. Coughlin, Livermore, CA (US); Allen L. D'Ambra, Burlingame, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 16/953,156

(22) Filed: Nov. 19, 2020

(65) Prior Publication Data

US 2022/0152666 A1 May 19, 2022

(51) Int. Cl.
*B08B 3/12* (2006.01)
*B08B 13/00* (2006.01)

(52) U.S. Cl.
CPC ..... *B08B 3/12* (2013.01); *B08B 13/00* (2013.01); *B08B 2203/0288* (2013.01)

(58) Field of Classification Search
CPC .... B08B 3/12; B08B 13/00; B08B 2203/0288
See application file for complete search history.

(56) References Cited

U.S. PATENT DOCUMENTS 2,987,068 A * 6/1961 Branson ..... B08B 3/12 134/1
3,473,670 A * 10/1969 Elftmann ..... A47L 15/30 211/163
2004/0168706 A1* 9/2004 Boyd ..... B08B 3/12 134/1.3
2014/0209239 A1 7/2014 Ko et al.
2018/0015701 A1 1/2018 Ambroise et al.
2020/0230661 A1 7/2020 Coughlin et al.

FOREIGN PATENT DOCUMENTS

CN 111219953 A 6/2020
CN 211938071 U 11/2020
JP 2008200660 A 9/2008
KR 100687296 B1 2/2007

OTHER PUBLICATIONS

International Search Report and Written Opinion for PCT/US2021/057129 dated Feb. 18, 2022.

* cited by examiner

*Primary Examiner* — Erin F Bergner
(74) *Attorney, Agent, or Firm* — Patterson + Sheridan LLP

(57) ABSTRACT

Disclosed herein is a sonic cleaning insert. In one example, the sonic cleaning insert includes a carousel configured to rotate about a central axis. The carousel further includes a platform having an outer perimeter. The platform is radially disposed about the central axis. The carousel has an inner ring and an outer ring circumscribing the inner ring. A plurality of partitions couple the inner ring and the outer ring to the platform. The plurality of partitions are arranged at a predetermined angle about the central axis. The carousel further includes a plurality of holders. Each holder is formed from a portion of the platform, a portion of each of the inner ring and outer ring, and a first sidewall and a second sidewall formed from the plurality of partitions. The carousel is configured for immersion in an ultrasonic vibrating fluid.

11 Claims, 6 Drawing Sheets

CAROUSEL FOR ULTRASONIC CLEANING AND METHOD OF USING THEREOF

BACKGROUND

Field

The present application relates to a carousel for ultrasonically cleaning workpieces, and a method of using thereof.

Description of the Related Art

Integrated circuits are formed on substrates by the sequential deposition of conductive, semiconductive, or insulative layers. After a layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface is periodically planarized in order to provide a relatively flat surface for additional processing. Chemical mechanical polishing (CMP) is one technique of planarization. This planarization technique requires that the substrate be mounted on a carrier or polishing head. The exposed surface of the substrate is placed against a polishing pad. The carrier head provides a controllable load, i.e., pressure, on the substrate to push it against the polishing pad, thus planarizing the non-planar outer surface of the substrate.

After any such CMP operation, it is necessary to clean the components of the CMP tool in order to remove particulates and contaminants from the contaminants. One method of removing contaminants is by immersing one or more components in a pool of fluid and bombarding the components with sound waves to remove the contaminants. The sound waves are generated via a transducer and propagate through the liquid to the components located in a tank holding the fluid. The sound waves cause cavitation proximate the components, which releases particles, such as dirt and grease, from the components.

Conventional sonic cleaners includes racks or the like that support the CMP components during cleaning. These racks can attenuate or absorb energy transferred by the ultrasonic and/or megasonic waves, reducing the effectiveness and efficiency of the sonic cleaner. In addition, utilizing racks in the conventional cleaners create "hot spots," i.e., erosion or anodization on a surface of the components. These hot spots are created by non-uniform power density produced by conventionally low frequencies of the transducers. The conventional sonic transducers create large bubbles that impart excessive energy on the components, which can erode a surface coating on the CMP component. Moreover, corners of the tanks may attenuate or disperse the sound waves, which prevents the energy in the sound waves from reaching the components, resulting in inefficient cleaning of the components.

Accordingly, there is need for an improved apparatus for cleaning CMP tool components.

SUMMARY

Disclosed herein is a sonic cleaning insert. In one example, the sonic cleaning insert includes a carousel configured to rotate about a central axis. The carousel further includes a platform having an outer perimeter. The platform is radially disposed about the central axis. The carousel has an inner ring and an outer ring circumscribing the inner ring. A plurality of partitions couple the inner ring and the outer ring to the platform. The plurality of partitions are arranged at a predetermined angle about the central axis. The carousel further includes a plurality of holders. Each holder is formed from a portion of the platform, a portion of each of the inner ring and outer ring, and a first sidewall and a second sidewall formed from the plurality of partitions. The carousel is configured for immersion in an ultrasonic vibrating fluid.

In another example of the disclosure, a sonic cleaning system is provided. The sonic cleaning system includes a tank having an inner surface and an outer surface. The inner surface is configured to contain a liquid that enables propagation of sonic waves. A plurality of sonic transducers is radially disposed about the inner surface of the tank. The sonic cleaning system has a carousel configured to rotate about a central axis. The carousel further includes a platform having an outer perimeter. The platform is radially disposed about the central axis. The carousel has an inner ring and an outer ring circumscribing the inner ring. A plurality of partitions couple the inner ring and the outer ring to the platform. The plurality of partitions are arranged at a predetermined angle about the central axis. The carousel further includes a plurality of holders. Each holder is formed from a portion of the platform, a portion of each of the inner ring and outer ring, and a first sidewall and a second sidewall formed from the plurality of partitions. The carousel is configured for immersion in an ultrasonic vibrating fluid.

In yet another example, a method for sonic cleaning is disclosed that method includes rotating a carousel about a central axis. The carousel is disposed in a tank and is further configured to hold a plurality of workpieces. The method further includes activating a plurality of sonic transducers a distance from central axis for ultrasonically vibrating a fluid disposed within the tank.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Disclosed herein is a carousel for ultrasonically cleaning CMP workpieces, and a method of using thereof. The CMP workpiece is a component of a CMP polishing tool, such as a polishing pad. Without limitation, the polishing pad can be a belt pad or a polishing pad, and the workpiece may also be any part of the CMP polishing tool that supports the polishing pad, or requires replacement or routine maintenance.

Ultrasonic cleaners include a tank filled with a liquid, the tank having ultrasonic transducers configured to produce high frequency waves (e.g., sound waves) that propagate through the liquid. As disclosed herein, one or more workpieces that are to be cleaned are placed into the liquid of the tank. The carousel holding the one or more workpieces is suspended and rotated within the tank. Therefore, the carousel of the instant disclosure does not require racks and other devices disposed within the tank that can reduce cleaning efficiency. Accordingly, the fluid within the tank utilizing the rotating carousel increases the amount of energy transferred from waves generated by the ultrasonic transducer. As such, an increase in cavitation proximate the workpiece is achieved.

High frequency sound waves are generated, such as by an ultrasonic transducer, and propagate through the liquid to the workpieces. The sound waves cause cavitation adjacent the workpieces, which releases particles, such as dirt and grease, from the workpieces. Advantageously, the rotating carousel disclosed herein reduces energy loss in the tanks by reflecting sound waves toward and/or focusing the sound waves on the workpieces, which improves the cleaning efficiency of the ultrasonic cleaning system. It is understood herein that frequencies from about 18 kHz to about 350 kHz can be considered ultrasonic frequencies, and frequencies at above 350 kHz are considered megasonic frequencies.

Figure 1:
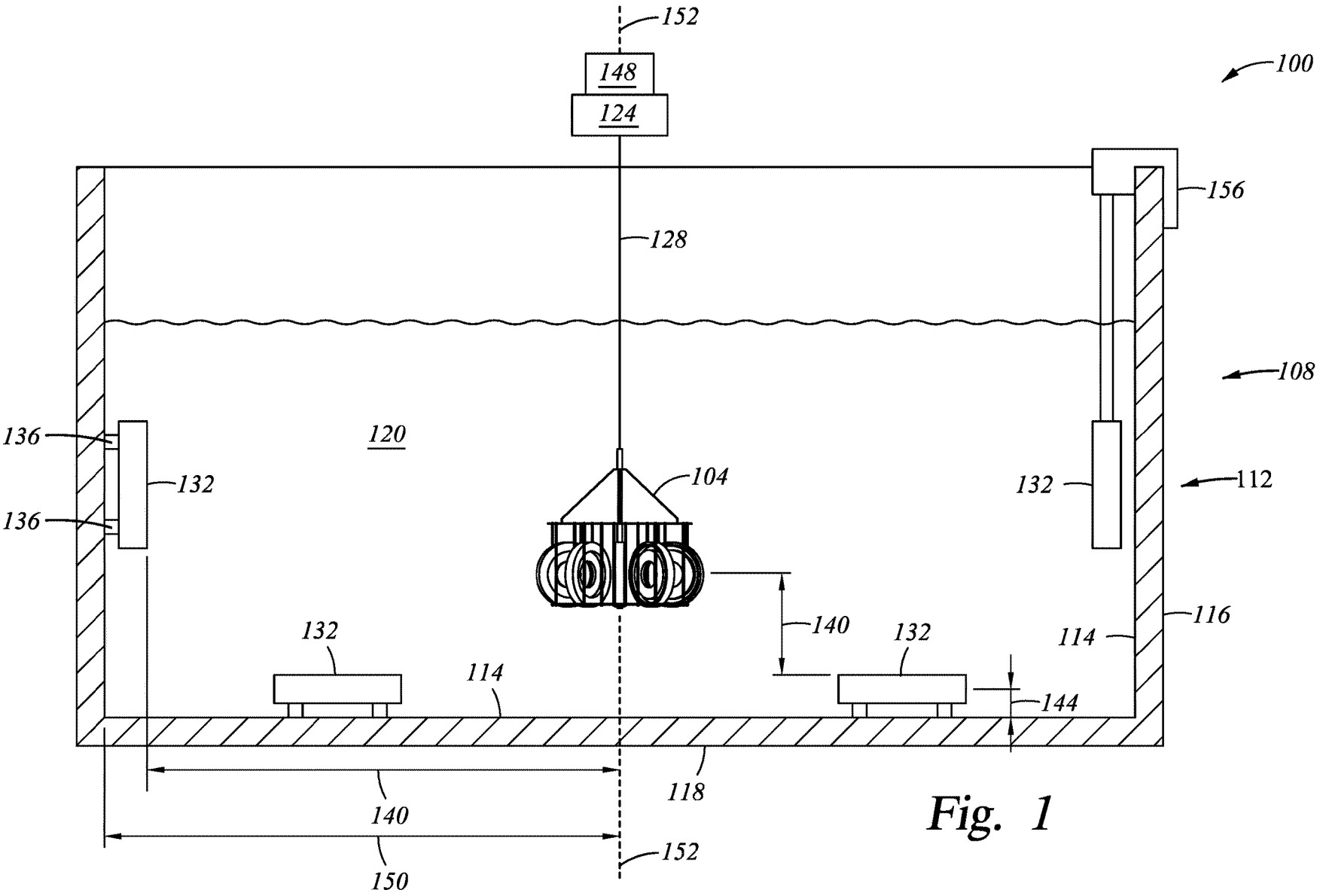
FIG. 1 is a schematic side view of an ultrasonic cleaning system having a carousel disposed therein.

FIG. 1 is a schematic side view of an ultrasonic cleaning system 100 having a carousel 104 disposed therein. The ultrasonic cleaning system 100 includes the carousel 104 disposed within a tank 108 and a plurality of ultrasonic transducers 132. The tank 108 has one or more walls 112 having an inner surface 114 and an outer surface 116 that is opposite the inner surface 114. The tank 108 has a bottom 118 coupled to the one or more walls 112. The bottom 118 can support one or more ultrasonic transducers 132. Power supplies (not shown) supply radio frequency (RF) power to ultrasonic transducers 132. The tank 108 may be at least partially filled with a liquid 120 that enables ultrasonic and/or megasonic waves generated by the ultrasonic transducers 132 to propagate. In some examples, the liquid 120 includes deionized water. In some examples, the liquid 120 includes one or more solvents, a cleaning solution such as standard clean1 (SC1), selective deposition removal reagent (SDR), surfactants, acids, bases, or any other chemicals useful for removing contaminants and/or particulates from a workpiece (shown in FIG. 2).

The carousel 104 can be completely submerged and surrounded by the liquid 120. As such, the carousel 104 may be suspended within the tank 108. For example, a connector 128 or similar device, may suspend the carousel 104 from a support 124. The connector 128 can include various straps, ropes, chains, lines, and other flexible linkages. The support 124 can be an overhead beam, metal bar, or similar support, to which the connector 128 can be attached. In other examples, other devices such as screws, bolts, and couplings may be employed to suspend the carousel 104 from the support 124 and/or the connector 128.

A motor 148 is coupled to the carousel 104 through the connector 128. In one example, the connector 128 is a shaft 216 (detailed in FIG. 2). The motor 148 is configured to rotate the carousel 104 within the tank 108 at a predetermined angular velocity. The motor 148 can be a DC or AC motor that provides torque to the shaft 216, and thereby rotates the carousel 104. The motor 148 can includes a rotor, stator, bearings, windings, and other components such as a commutator. As illustrated, the motor 148 is adjacent to the support 124, but it is understood that motor 148 is not limited to this position and can be positioned at any location along the shaft connector 128, above the connector 128, or below the connector 128. In some example, the motor 148 can be submerged in the liquid 120 without departing from the scope of the disclosure.

The carousel is in direct contact with the liquid 120 and the connector 128. By suspending the carousel 104 within the tank 108, more energy may transfer proximate the carousel 104 to clean the workpiece 252 (shown in FIG. 2) compared with conventional ultrasonic cleaners. For example, more energy in the form of ultrasonic and/or megasonic waves may be available to cavitate the liquid 120 proximate the carousel 104.

In one example, by locating the ultrasonic transducer 132 proximate an inner surface 114 of the tank 108 the ultrasonic and/or megasonic waves emitted by the ultrasonic transducer 132 may propagate within the tank 108 and release energy adjacent to the carousel 104, which supports the workpieces 252. For example, ultrasonic and/or megasonic waves emitted by the ultrasonic transducer 132 may reflect from the inner surface 114 toward the carousel 104. Accordingly, the ultrasonic and/or megasonic waves generated by the ultrasonic transducer 132 are not attenuated at the corners of tank 108. Additionally, more energy from ultrasonic and/or megasonic waves is utilized for cavitation. Each ultrasonic transducer 132 is configured to impart between about 900 Watts and about 1500 Watts, such as about 1000 Watts or about 1150 Watts energy to the liquid 120. In another example, each ultrasonic transducer 132 is configured to impart between about 1100 Watts and about 1350 Watts, such as about 1250 Watts or about 1300 Watts.

Transducer supports 136 connect the ultrasonic transducer 132 to the inner surface 114 of the tank 108. In one example, the transducer supports 136 can raise the ultrasonic transducer 132 an offset distance 144 from the bottom 118 to form a space between the ultrasonic transducer 132 and the bottom 118. The offset distance 144 can be between about 1 inch to about five inches, such as about two inches or about four inches. In some examples, the offset distance 144 is less than about 0.5 inches. In another example, the offset distance 144 is substantially zero (0), such that the ultrasonic transducer 132 is flush-mounted with the bottom 118. For example, the each ultrasonic transducer 132 may be secured to the bottom 118 of the tank 108 with a fastener, such as a bolt or a screw. As such, the transducers supports 136 can be the fastener for securing the ultrasonic transducer 132, in some examples. The space between the ultrasonic transducer 132 and inner surface 114 of the bottom 118 may mechanically isolate the ultrasonic transducer 132 from the walls 112 and the bottom 118 of the tank 108. In another example, the space between the bottom 118 and the ultrasonic transducer 132 is less than about six inches. However, it is understood that larger or smaller spaces can be used without departing from the scope of this disclosure.

When activated, the ultrasonic transducer 132 can produce ultrasonic and/or megasonic waves within the liquid 120. A distance 140 between the ultrasonic transducer 132 and the workpieces 252 and the carousel 104 is determined during a cleaning recipe, explained in more detail below. The distance 140 includes vertical (z) and horizontal (x and y) components for each ultrasonic transducer 132. The vertical and horizontal components can be the same for each ultrasonic transducer 132 on the inner surface 114 of the walls 112 and the bottom 118. Alternatively, the vertical and horizontal components can be different between the ultrasonic transducers 132 on the inner surface 114 of the walls 112 and the bottom 118. In another example, where the inner surface 114 of the tank 108 has a circular circumference, the waves generated by the ultrasonic transducer 132 reflect from the inner surface 114 towards the carousel 104. Accordingly, more energy is transferred proximate the carousel 104 than with conventional ultrasonic cleaners. As such, the ultrasonic transducers 132 disclosed herein increase cavitation of the liquid 120 in the tank 108 proximate the carousel 104.

The tank 108 has a perimeter P that is defined by a radius 150 measured from a centerline 152 extending to the inner surface 114 of the tank 108. In one example, one or more ultrasonic transducers 132 are submerged in the liquid 120 by suspending each ultrasonic transducer 132 from a hanger 156 positioned on the tank 108. The hanger 156 is detachably coupled to the ultrasonic transducer 132. As such, each ultrasonic transducer 132 has a radial component defined by the radius 150 enabling each ultrasonic transducer 132 to be placed at any location along the perimeter P. The radial component can be expressed as an angle $\Theta$, or an arc length s. For example, if the tank 108 is a circle, the tank 108 has a perimeter $P=2\pi r$, where r equals the radius 150. Accordingly, each component. In another example, where the tank 108 is substantially a square, the perimeter P is defined as 4*w, where w is equal to a width of one side of the tank 108.

In other examples, where the tank 108 is not substantially square, the perimeter P is defined by $\Sigma_1^m w$, where m is equal to number of inner surface 114 of the tank 108. In another example, the ultrasonic transducers 132 are positioned at a radially equidistant angle $r_{eq}$, the $r_{eq} \leq N/P$, where N is the number of ultrasonic transducers 132 and P is the perimeter, as defined above. In yet other example, the ultrasonic transducers 132 are not arranged equidistantly about the inner surface 114 of the tank 108, such that the arc length s is less than a length of the perimeter P and greater than the width of a given ultrasonic transducer 132, enabling a spacing or gap between adjacent ultrasonic transducers 132. Accordingly, the angle $\Theta$ at which an ultrasonic transducer is arranged is greater than s/r, in order to accommodate the gap between the adjacent ultrasonic transducers 132 and less than $2\pi$.

Figure 2:
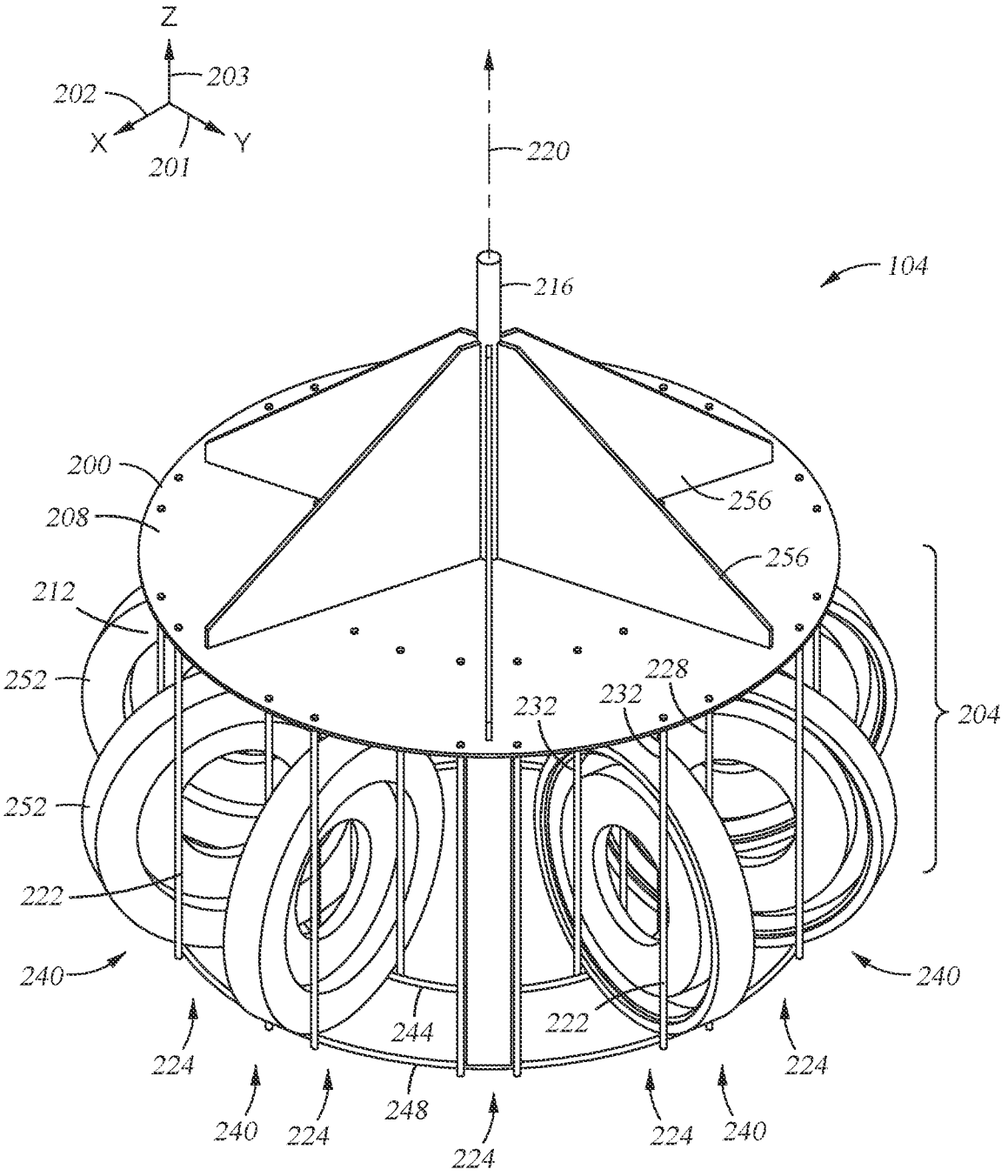
FIG. 2 illustrates an isometric view of one example of the carousel shown in FIG. 1.

FIG. 2 illustrates an isometric view of one example of the carousel 104 shown in FIG. 1. The carousel 104 includes a platform 200 coupled to a carrier 204, and a plurality support features 256 coupled to the platform 200. The platform 200 has an upper surface 208 and a lower surface 212 opposite the upper surface 208. The carrier 204 extends from the lower surface 212 of the platform 200 in the negative z-direction 203. A shaft 216, rotatable about a central axis 220, is configured to couple to the connector 128 (FIG. 1), in one example. In another example, the shaft 216 is integral with the connector 128, shown in FIG. 1. The shaft 216 is physically coupled to the platform 200 and applies rotating torque to the shaft 216 when the motor 148 is in operation. In one example, the shaft 216 terminates at the 208 of the platform 200. Alternatively, the shaft 216 extends through upper surface 208 and the lower surface 212 of the platform 200, the shaft 216 remaining coupled thereto. In one example, central axis 220 of the carousel 104 substantially aligns with the centerline 152 of the tank 108. It is understood however, that in other example, the centerline 152 and the central axis 220 may not align without departing from the aspects of disclosure as described herein.

The carrier 204 includes a plurality of holders 224, an inner ring 244, and an outer ring 248. The plurality of holders 224 extend radially around the central axis 220. Each holder of the plurality of holders 224 includes a first sidewall 228 and a second sidewall 232. The first sidewall 228 and the second sidewall 232 each include one or more partitions 222 of a plurality of partitions 222. Each holder 224 is bound by a lower surface 212 of the platform 200 on one end of the carrier 204. Additionally, each holder 224 is bound by the inner ring 244 and the outer ring 248 on the other end of the carrier 204. The inner ring 244 has a smaller diameter than a diameter of the outer ring 248, such that outer ring 248 completely circumscribes the inner ring 244. The inner ring 244 and outer ring 248 are shown as cylindrical rings, but are not limited to that shape. Each of the inner ring 244 and outer ring 248 can be formed as a circle, quadrilateral, or square.

In the example illustrated, plurality of partitions 222 forming the first sidewall 228 and the second sidewall 232 are formed from bars or rods, which can be made of metal, plastic, polymer, or a compositions thereof. For example, forming the partitions 222 from bars enables the first sidewall 228 and the second sidewall 232 to each have an opening between adjacent partitions 222. Each holder 224 is formed from a substantially quadrilateral arrangement of partitions 222, such that there are six sides, five of which have openings. The first sidewall 228 and the second sidewall 232 are formed in opposing sides of the quadrilateral arrangement of partitions 222, and have the largest openings of each holder 224. Advantageously, energy emitted from the transducers 132 has a direct line of sight path to each workpiece 252. Additionally, the plurality of partitions 222 minimize the energy absorbed from the transducers, thus conserving more energy for cavitation. A material selected for the plurality of partitions reflects at least one of ultrasonic waves and megasonic waves.

A slot 240 is defined by a space or gap formed between the inner ring 244 and the outer ring 248, each having dimension in the x-direction 201 and y-direction 202. The slot 240 is further defined by the first sidewall 228 and the second sidewall 232 extending in the y-direction 202. A length of the slot 240 is defined by the inner ring 244 and outer ring 248 in the x-y plane. The x-y plane has dimension in the x-direction 201 and the y-direction 202. A width of the slot 240 is defined by a distance between the first sidewall 228 and the second sidewall 232. Accordingly, in one example, the width of the slot 240 that is bound by the inner ring 244 is the same as the width of the slot 240 bound by the outer ring 248. In another example, the width of the slot 240 bound by the inner ring 244 is shorter than the width of the slot 240 bound by the outer ring 248. One or more workpieces(s) 252 are held within the carrier 204 by the plurality of holders 224. Each workpiece 252 sits within the slot 240 of the holder 224. The workpiece 252 extends partially below a plane in formed by the inner ring 244 and the outer ring 248, because the space/gap within the slot 240 enables a portion of the workpiece 252 to extend therethrough.

Support features 256 are coupled to and extend from the upper surface 208 of the platform 200 in the positive z-direction 203, and extend radially from the central axis 220 in the x-y plane. As shown, the support features 256 extend radially from the shaft 216, and in one example, the support features 256 are coupled to the shaft 216 and/or the platform 200 by welding. In another example, the support features 256 are coupled to the shaft 216 and/or the platform 200 by an adhesive, or by one or more fixing members, such as bolts, screws, or other suitable couplings. It is understood that the platform 200 and the carrier 204 can be welded or coupled with the fixing members in substantially the same manner as described above.

Figure 3:
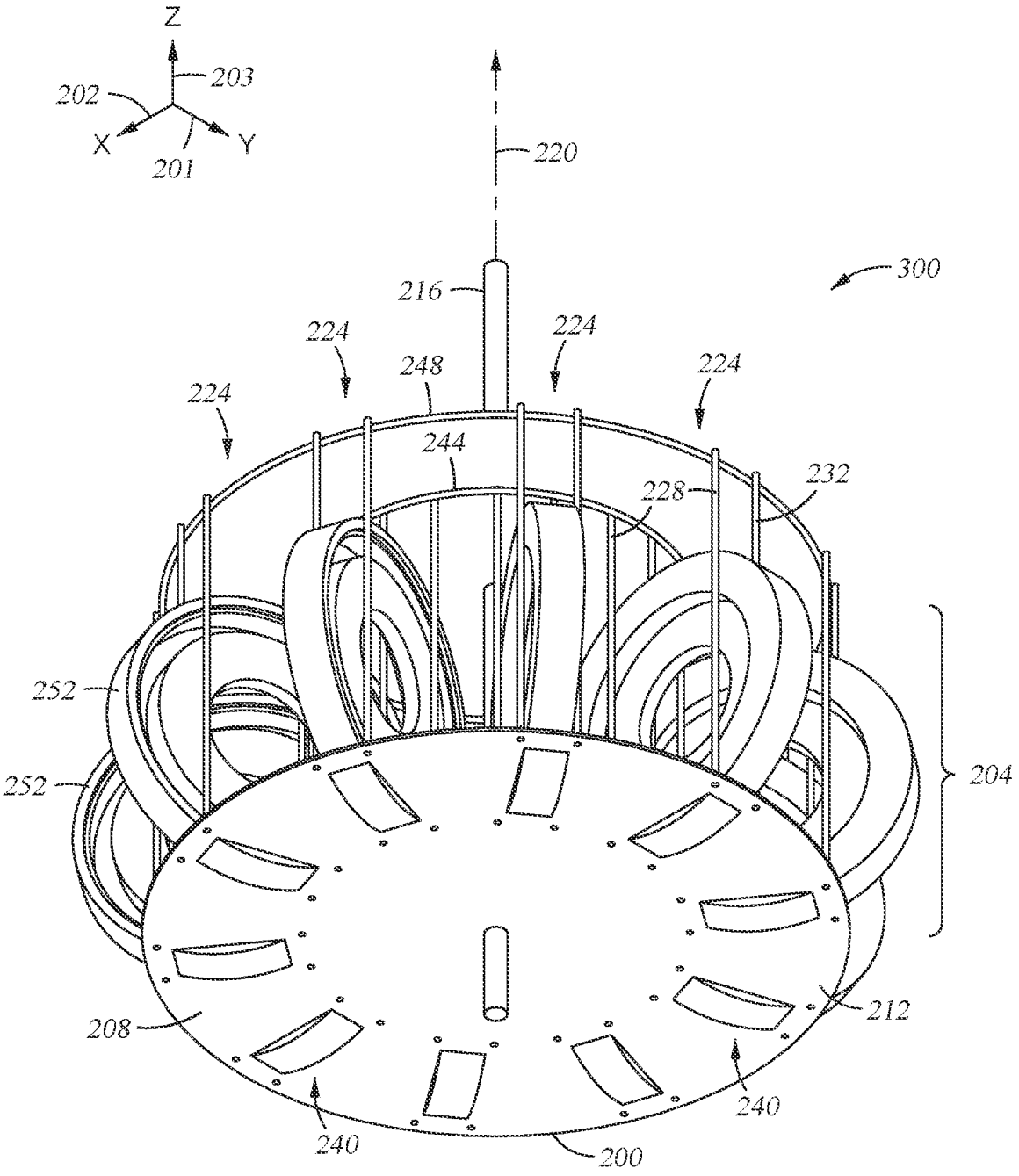
FIG. 3 shows an isometric view of an alternative example of the carousel shown in FIG. 2.

FIG. 3 shows an isometric view of an alternative example of the carousel 104 shown in the ultrasonic cleaning system 100 of FIG. 2. An alternative carousel 300 has the shaft 216 extending from the upper surface 208 of the platform 200, passing through to the lower surface 212. The carrier 204 extends from the upper surface 208 of the platform 200 in the positive z-direction 203. Each workpiece 252 rests on the upper surface 208 when the workpiece 252 is disposed in the holder 224. As the carousel 300 rotates, each slot 240 holds its respective workpiece 252 within the carousel 300, because a portion of each workpiece 252 extends through an opening in the partitions 222. Support features 256 extend from the upper surface 208 of the platform 200 in the positive z-direction 203 to the shaft 216. The support features 256 extend radially from the central axis 220, such that the carrier 204 surrounds the support features 256.

Figure 4A:
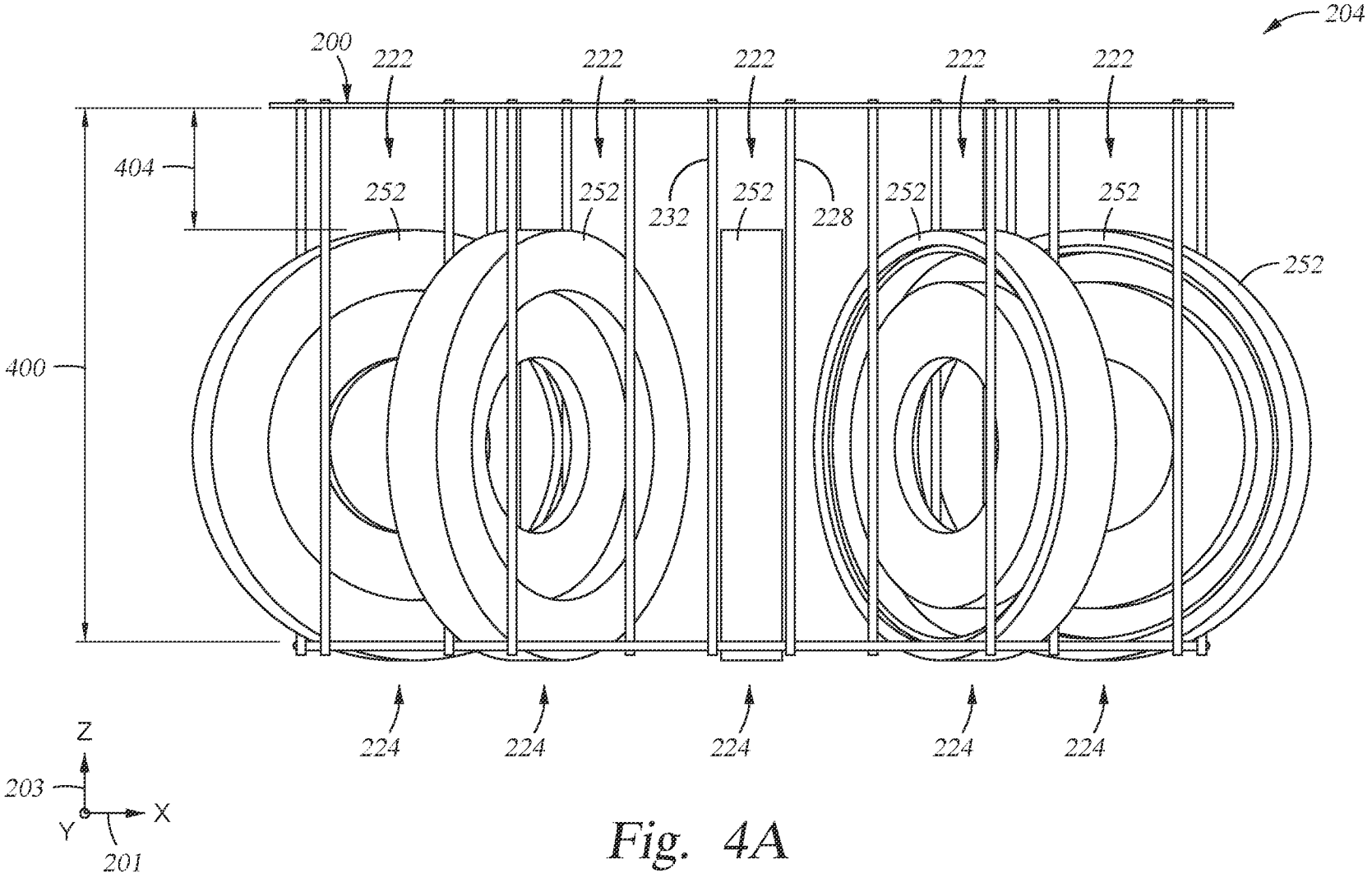
FIG. 4A is a side view of the carousel shown in FIGS. 1-3 having a plurality of holders supporting a plurality of workpieces.

FIG. 4A is a side view of the carousel 104, shown in FIGS. 1-3, depicting the plurality of holders 224 for supporting the plurality of workpieces 252. The carrier 204 has a height 400 that is suitable for accommodating each workpiece 252, such that a clearance 404 is formed between the workpiece 252 and a top of the carrier 204, when the carrier 204 is oriented as shown in FIG. 2. Alternatively, the clearance 404 is between the workpiece 252 and the inner ring 244 and outer ring 248 when the carrier 204 is oriented as show in FIG. 3. The slot 240 is configured to hold each workpiece 252 within the holder 224 as the carousel 300 rotates. Accordingly, each holder 224 has the height 400 and width that is greater than each workpiece 252. As described above, the slot 240 thereby enables a portion of each workpiece 252 to extend beneath the carrier 204 between the inner ring 244 and outer ring 248. By extending a portion of each workpiece 252 outside of a circumference of the carrier 204, the carousel enables a line of sight between each workpiece 252 and one or more ultrasonic transducers 132. Maintaining a line of sight enables efficient cavitation as more energy from the ultrasonic transducers 132 is transferred to the liquid 120 and ultimately produced cavitation in the liquid 120.

Figure 4B:
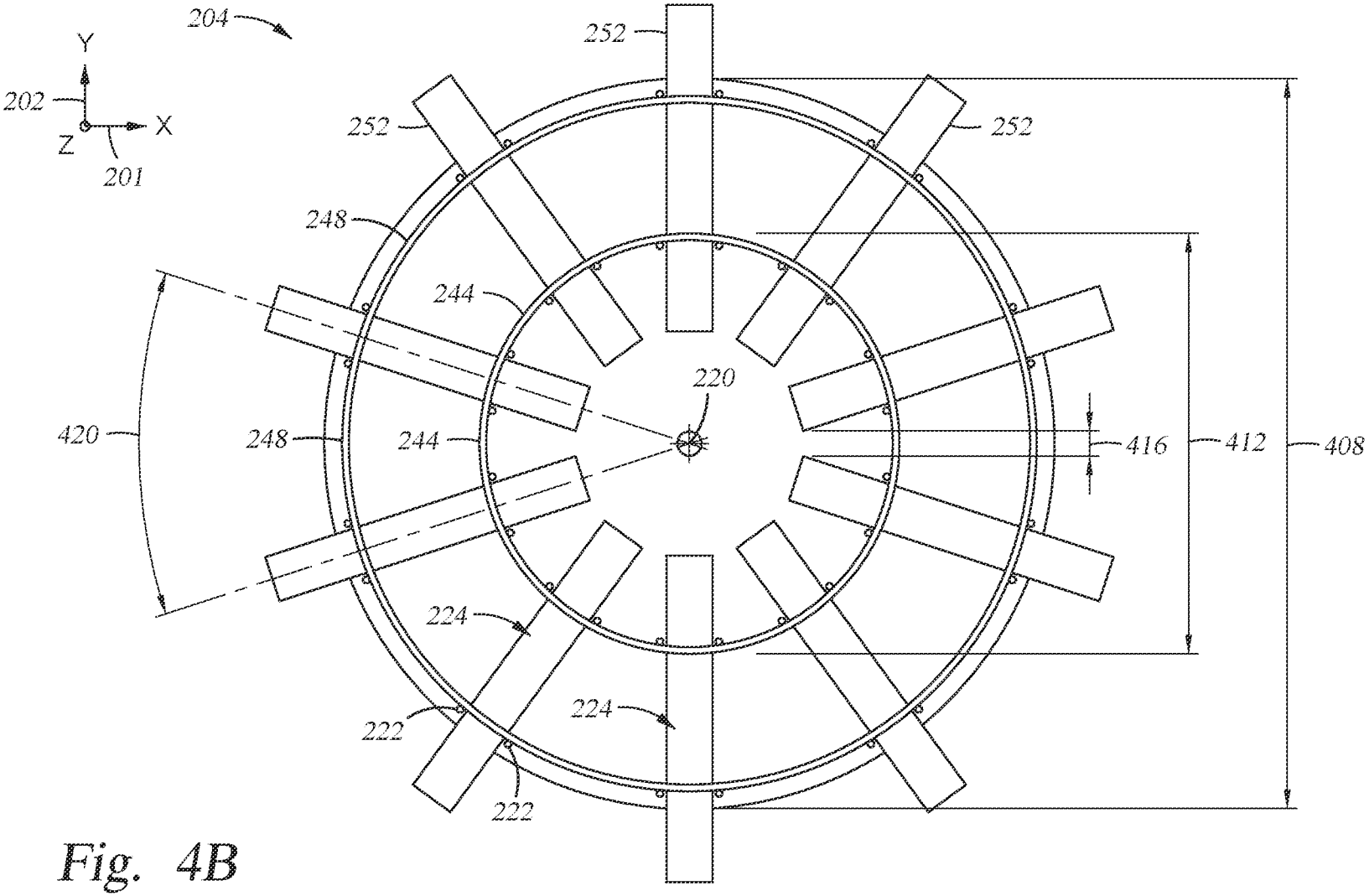
FIG. 4B is a bottom view of the carousel as shown from line B-B in FIG. 4A.

FIG. 4B is a bottom view of the plurality of holders 224 shown in as viewed from line B-B FIG. 4A. FIG. 4B is a bottom view of the carousel as shown from line B-B in FIG. 4A The carrier 204 has an outer diameter 408 sufficient to accommodate each workpiece 252, while enabling a portion of at least one of the workpieces 252 to extend beyond a circumference of the outer ring 248. The inner ring 244 has an inner diameter 412 such that a circumference of the inner ring 244 enables at least one inner portion of the workpiece 252 to extend over the inner ring 244 toward the central axis 220. Extending the workpiece 252 beyond the inner ring 244 and outer ring 248 in this manner enables the liquid 120 to circulate around and through each workpiece 252 more efficiently, as less energy in the liquid is lost upon collision with surfaces of the carousel 104 that are not desired to be cleaned. The plurality of holders 224 are formed at angle 420 around the central axis 220 of the carrier 204, such that a gap 416 is formed between each workpiece 252. The gap 416 and the angle 420 are a function of the inner diameter 412 and the outer diameter 408. Accordingly, the gap 416 and the angle 420 can be optimized to facilitate cleaning of the workpiece 252. In one example, the angle 420 is less than or equal to $N/2\pi$, where N is the number of workpieces 252. In one example, the angle 420 is between about 15 degrees and about 35 degrees, such as about 20 degrees or about 25 degrees.

Figure 5:
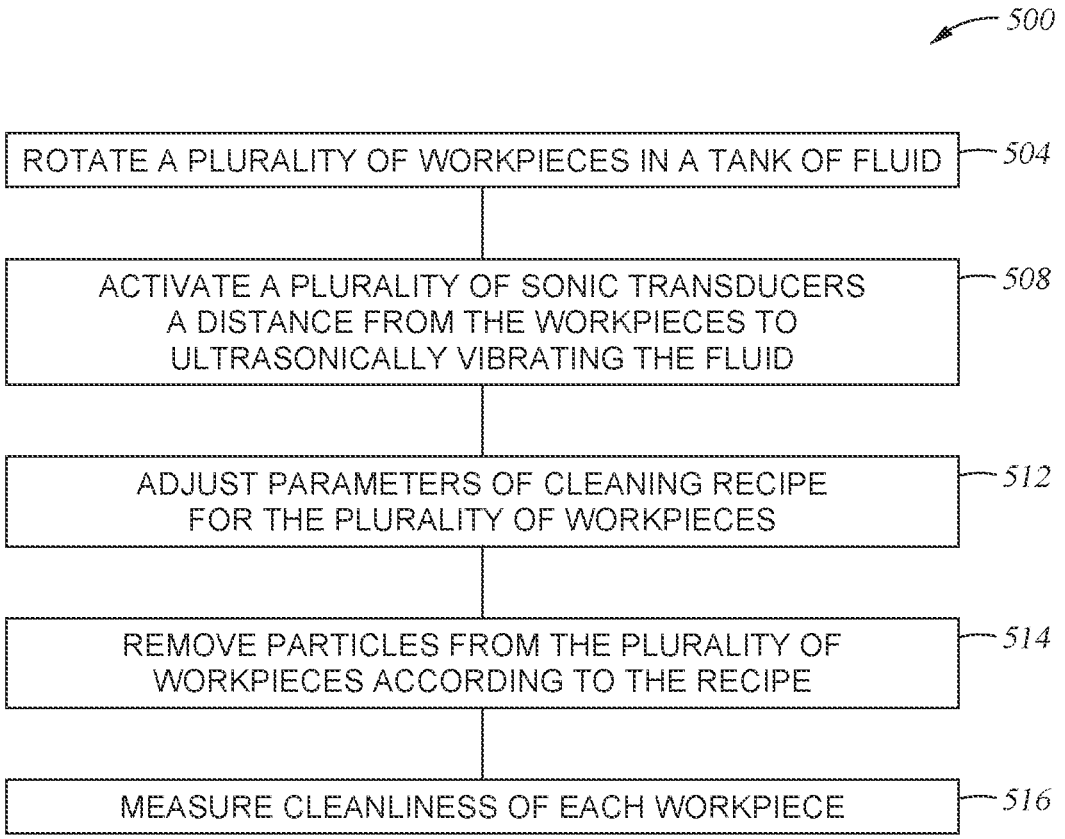
FIG. 5 is a flow chart of a method of cleaning a plurality of workpieces with the carousel shown in FIGS. 1-4B.

FIG. 5 is a flow chart of a method of cleaning a plurality of workpieces with the carousel shown in FIGS. 1-3. At operation 504, a plurality of workpieces are rotated in a tank of fluid. In one example, the plurality of workpieces 252 are disposed in the carousel 104. The carousel 104 is rotated about the central axis 220, thus rotating the workpieces 252 submerged in the liquid 120 about the central axis 220 of the carousel 104.

The method 500 proceeds to operation 508 by activating a plurality of sonic transducers a distance from the workpieces to ultrasonically vibrating the fluid. In one example, ultrasonic transducers 132 are positioned the distance 140 from the workpieces 252. The distance 140 is between about 8 inches and about 36 inches, such as about 12 inches. In another example, the distance 140 is between about 15 inches and about 25 inches, such as about 24 inches or about 20 inches. In yet another example, the distance 140 is less than or equal to about 16 inches or less than about 12 inches, or about 10 inches. As noted above, the distance 140 between the ultrasonic transducers 132 mounted to the wall 112 or the bottom 118 of the tank 108, can be equidistant or have different distances. In one example, the distance 140 between each ultrasonic transducers 132 and the central axis 220 of the carousel 104 is equidistant. One advantages is that a resonance frequency can be achieved more quickly when the ultrasonic transducers 132 are arranged equidistant from central axis of the carousel 104.

Parameters of a cleaning recipe are adjusted at operation 512. Parameters of the cleaning recipe can include a frequency of the transducers, power transmitted to the fluid by the transducers, a deoxygenation level of the fluid, a rotation speed of the workpieces, and a duration of the carousel rotation. For example, the ultrasonic transducers 132 receive power from a power supply (not shown) such that ultrasonic transducers 132 vibrate a frequency between about 50 kHz and about 100 kHz, such as about 55 kHz. In another example, the plurality of ultrasonic transducers 132 vibrate at a frequency between about 60 kHz and about 85 kHz, such as about 70 kHz. In another example, the frequency of the ultrasonic transducers 132 vibrate between about 75 kHz and about 85 kHz, such as about 80 kHz. A size of each cavity or bubble becomes smaller utilizing the above-noted frequencies, thus imparting less energy per cavity to each workpiece 252. As such, the frequencies disclosed above enable cleaning of each workpiece 252 while reducing the occurrence of hot spots or anodization associated with larger bubbles of the conventional ultrasonic cleaner.

Each of ultrasonic transducers 132 is configured to transfer between about 750 Watts and about 1500 Watts of energy to the liquid 120. In one example, the energy transferred to the liquid 120 is between about 850 Watts and about 1350 Watts, such as about 900 Watts, or about 950 Watts. In another example, the energy transferred to the liquid 120 is between about 1100 Watts and about 1300 Watts, such as about 1150 Watts, or about 1250 Watts, or about 1275 Watts.

During cavitation, the small vapor-filled cavities can form in the liquid 120 creating cavities, i.e., bubbles or voids, where the pressure in the liquid 120 is relatively low. When the cavities collapse, a shock wave can generate proximate the bubble extending radially outward from each cavity. Energy from the shockwaves removes particles from each workpiece 252. The plurality of partitions 222 enable greater surface area of each workpiece 252 to be exposed to the liquid 120 such that energy from the ultrasonic transducers 132 is transferred to cavitation and the removal of particles from each workpiece 252. The plurality of partitions 222 allow for a line of sight to be maintained between at least one of the ultrasonic transducers 132 and substantially each point on the surface of a respective workpiece 252. Conventional holders require more surface contact between each workpiece and the conventional holder, thus reducing the energy available for cavitation of the fluid and thereby reducing the efficiency and effectiveness of the cleaning process.

The cleaning recipe includes oxygenation parameters of the fluid. For example, the liquid 120 has an oxygen content between about 1 ppb and about 20 ppb, such as about 15 ppb. In another example, the oxygen content of the liquid 120 is between about 5 ppb and about 15 ppb, such as about 7 ppb, or about 10 ppb. In yet another example, the oxygen content of the liquid 120 is less than or equal to about 10 ppb, or less than or equal to about 5 ppb.

A rotational speed of the carousel 104 is between about 5 rpm and 50 rpm, such as about 15 rpm or 20 rpm. In another example, the carousel 104 rotates between about 25 rpm and about 40 rpm, such as about 30 rpm or about 35 rpm. The rotational speed is adjusted to optimize cleaning of the workpiece 252 by varying the rate of cavitation at the surface of each workpiece 252. The carousel 104 may rotate for a duration of about 10 minutes to about 60 minutes, such as about 20 minutes. In another example, the duration of carousel 104 rotation is between about 15 minutes and about 45 minutes, such as about 25 minutes. In another example, the duration is between about 25 minutes and about 35 minutes. In another example, the duration is between about 27 minutes and about 33 minutes, such as about 30 minutes.

At operation 514 particles from the workpieces are removed by resonating the fluid in the tank. The cleaning recipe can include a resonance mode in which the ultrasonic transducers 132 cause the liquid 120 to resonate at or near the natural frequency of the liquid 120. Resonating the liquid 120 optimizes the rate of energy transferred to cavitation of each workpiece 252. During resonance of the liquid 120, more energy transferred from the ultrasonic transducers 132 to surfaces of each workpiece 252. In one example, which can be combined with other examples above, a shape of tank 108 is circular. The tank 108 having a circular shape enables energy to be evenly focused toward the carousel 104. Moreover, energy reflected from the carousel 104 towards the inner surface 114 is redirected back to the center of the tank 108 and the carousel 104. Reflecting energy back towards the center of the tank 108 increases the power density of the liquid 120 and thus increases the rate and/or density of cavitation of the liquid 120. It is understood that the shape of the of the tank 108 is not limited to a circle or circular shape, and can be any shape suitable for holding the liquid 120. However, advantageously, the circular shape of the tank 108 eliminates dead zones, i.e., a volume of the fluid in which power density of the fluid is significantly reduced inhibiting cavitation of the fluid, due to interference caused by sound waves in the fluid canceling one another.

An optional operation 516 can be performed where a level of cleanliness of each workpiece is determined. Each workpiece can be tested in a liquid particle counter (LPC) to determine a level of contamination of the workpiece. If the cleanliness of each workpiece surpasses a predetermined threshold, the method 500 can terminate. If one or more workpieces has not surpassed the predetermined threshold, operation 516 proceeds to operation 504 and the method continues until the workpieces has surpassed the predetermined threshold of cleanliness.

Disclosed herein are examples of a carousel for ultrasonically cleaning workpieces, and a method of using thereof. Advantageously, utilizing the carousel reduces energy loss in the tanks by reflecting sound waves towards the workpieces, thus improving the cleaning efficiency of the ultrasonic transducers. While the foregoing is directed to specific examples, other examples may be devised without departing from the scope of the disclosure.

What we claim is:

1. A sonic cleaning insert comprising:
a carousel configured to rotate about a central axis, the carousel further comprising:
a platform having an upper surface and a lower surface opposite the upper surface, the platform radially disposed about the central axis;
an inner ring and an outer ring at the lower surface of the platform, the outer ring circumscribing the inner ring with a radial opening from the inner ring; and
a plurality of first partitions extending from the inner ring to the upper surface of the platform and being covered by the upper surface of the platform, and a plurality of second partitions extending from the outer ring to the upper surface of the platform, wherein the plurality of first partitions and the plurality of second partitions are arranged at a predetermined angle about the central axis,
wherein the carousel is configured to retain a workpiece covered by the upper surface of the platform and between adjacent first partitions of the plurality of first partitions and through the radial opening between the inner ring and the outer ring for immersion in an ultrasonic vibrating fluid.

2. The sonic cleaning insert of claim 1,
a rotatable shaft coupled to the upper surface of the platform, the rotatable shaft configured to rotate the platform about the central axis.

3. The sonic cleaning insert of claim 2, further comprising:
a plurality of support features radially disposed about the central axis, the plurality of support features extending from the rotatable shaft and coupled to the platform.

4. The sonic cleaning insert of claim 1, wherein the carousel is configured to receive a workpiece between adjacent first partitions of the plurality of first partitions.

5. The sonic cleaning insert of claim 1, wherein each of the plurality of first partitions and each of the plurality of second partitions are disposed about the central axis at the predetermined angle, the predetermined angle proportional to a number of partitions of the plurality of partitions.

6. The sonic cleaning insert of claim 1, further comprising:
a plurality of support features radially disposed about the central axis, the plurality of support features extending from a rotatable shaft coupled to a surface of the platform, wherein each support feature of the plurality of support features is disposed about the central axis at a supporting angle, the supporting angle being less than or equal to the predetermined angle.

7. A sonic cleaning system comprising:
a tank having an inner surface and an outer surface, the inner surface configured to contain fluid that enables propagation of sonic waves;
a plurality of sonic transducers radially disposed about the inner surface of the tank; and
a sonic cleaning insert positioned for insertion into the tank, comprising:

a carousel configured to rotate about a central axis, the carousel further comprising:

a platform having an upper surface and a lower surface opposite the upper surface, the platform radially disposed about the central axis;

an inner ring and an outer ring at the lower surface of the platform, the outer ring circumscribing the inner ring with a radial opening from the inner ring; and a plurality of first partitions extending from the inner ring to the upper surface of the platform and being covered by the upper surface of the platform, and a plurality of second partitions extending from the outer ring to upper surface of the platform, wherein the plurality of first partitions and the plurality of second partitions are arranged at a predetermined angle about the central axis, wherein the carousel is configured to retain a workpiece covered by the upper surface of the platform and between adjacent first partitions of the plurality of first partitions and through the radial opening between the inner ring and the outer ring for immersion in an ultrasonic vibrating fluid.

8. The sonic cleaning system of claim 7, a rotatable shaft coupled to the upper surface of the platform, the rotatable shaft configured to rotate the platform about the central axis.

9. The sonic cleaning system of claim 8, further comprising:

a plurality of support features radially disposed about the central axis, the plurality of support features extending from the rotatable shaft and coupled to the platform.

10. The sonic cleaning system of claim 7, wherein the tank comprises a bottom and wherein the plurality of sonic transducers is located an offset distance from the bottom.

11. The sonic cleaning system of claim 7, wherein each first partition of the plurality of first partitions and each second partition of the plurality of second partitions are made of a material that reflects at least one of ultrasonic waves and megasonic waves.

* * * * *